US008887617B2

(12) United States Patent
Pflaumer et al.

(10) Patent No.: US 8,887,617 B2
(45) Date of Patent: Nov. 18, 2014

(54) RECOIL-SPRING DEVICE FOR A HANDGUN

(71) Applicant: Carl Walther GmbH, Ulm (DE)

(72) Inventors: Wulf-Heinz Pflaumer, Arnsberg (DE); Franz Wonisch, Arnsberg (DE); Enrico Rau, Langenau (DE)

(73) Assignee: Carl Walther GmbH, Ulm (DE)

( * ) Notice: Subject to any disclaimer, the term of this patent is extended or adjusted under 35 U.S.C. 154(b) by 32 days.

(21) Appl. No.: 13/650,432

(22) Filed: Oct. 12, 2012

(65) Prior Publication Data

US 2013/0092018 A1 Apr. 18, 2013

(30) Foreign Application Priority Data

Oct. 12, 2011 (DE) ..... 10 2011 115 771

(51) Int. Cl.
*F41A 3/86* (2006.01)
*F41A 3/82* (2006.01)

(52) U.S. Cl.
CPC ..... *F41A 3/82* (2013.01)
USPC ..... 89/198

(58) Field of Classification Search
CPC ..... F41A 3/82; F41A 11/00; F41A 5/18; F41A 11/02; F41A 3/64
USPC ..... 89/194, 199, 196, 198, 163; 42/69.01
See application file for complete search history.

(56) References Cited

U.S. PATENT DOCUMENTS

| | | | | | |
|---|---|---|---|---|---|
| 3,411,406 | A | * | 11/1968 | Pachmayr et al. | 89/196 |
| 3,901,125 | A | * | 8/1975 | Raville | 89/163 |
| 4,201,113 | A | * | 5/1980 | Seecamp | 89/199 |
| 4,485,723 | A | * | 12/1984 | Sarony | 89/163 |
| 5,054,368 | A | * | 10/1991 | Wentzel et al. | 89/196 |
| 5,069,110 | A | * | 12/1991 | Menck | 89/198 |
| 5,127,310 | A | * | 7/1992 | Lishness et al. | 89/199 |
| 5,392,689 | A | * | 2/1995 | Buzzeo et al. | 89/196 |
| 5,741,996 | A | * | 4/1998 | Ruger et al. | 89/196 |
| 6,631,669 | B2 | | 10/2003 | Weldle | |
| 2002/0046644 | A1 | * | 4/2002 | Weldle | 89/199 |

FOREIGN PATENT DOCUMENTS

DE 3541173 A1 8/1986

* cited by examiner

*Primary Examiner* — Samir Abdosh
*Assistant Examiner* — John D Cooper
(74) *Attorney, Agent, or Firm* — Bachman & LaPointe, P.C.

(57) ABSTRACT

In a recoil-spring device (100) in a handgun equipped with a breech and a recoil spring (110) in the form of a spiral spring, whose rear end abuts a rear stop member (123) on a recoil spring rod (120) and whose front end is mounted for movement along the recoil-spring rod (120) with contraction of the recoil spring (110), support in an uncomplicated recoil-spring eyelet is achieved in that the front end of the recoil spring (110) abuts, at least indirectly, a rear contact surface (132) of a contact element (131) that is mounted for movement along said contact-spring rod (120), while the front contact surface (133) is in contact with an internal surface of the breech of the handgun.

20 Claims, 3 Drawing Sheets

RECOIL-SPRING DEVICE FOR A HANDGUN

BACKGROUND OF THE INVENTION

The invention relates to a recoil-spring device for a handgun comprising a breech device (slide), which recoil-spring device comprises a recoil spring which is in the form of a spiral spring and the rear end of which abuts a rear stop member on a recoil-spring rod and the front end of which is mounted for movement along the recoil-spring rod with contraction of the recoil spring.

Recoil-spring devices of the above type are used in the prior art to install a recoil spring in the biased state in a handgun. A recoil spring is compressed when the breech device recoils after a shot has been fired, the direction of recoil being opposite to the direction of motion of the projectile, and as a result it converts the kinetic energy of the breech device into potential spring energy that causes the breech device to move forward, after it has hit the grip of the handgun, to its starting position for firing.

SUMMARY OF THE INVENTION

However, the prior recoil-spring devices suffer from the disadvantage that a recoil-spring eyelet provided in the region of a front surface of the breech device for mounting a front end face of the recoil-spring device is complicated and therefore expensive to produce.

It is therefore an object of the invention to provide a recoil-spring device that forms a compact unit and that can be readily inserted by hand into a weapon and removed therefrom and can be installed in a handgun without any elaborately designed recoil-spring eyelet.

For a recoil-spring device of the above type, this object is achieved, according to the invention, in that the front end of the recoil spring abuts, at least indirectly, a rear contact surface of a contact element of a recoil-spring slide that is mounted for movement along the recoil-spring rod, while a front contact surface of the contact element is in contact with an internal surface of the breech device of the handgun.

Preferred embodiments of the invention are the subject matter of the subordinate claims.

In the recoil-spring device of the invention, the combination of features to the effect that the front end of the recoil spring abuts, at least indirectly, a rear contact surface of a contact element of a recoil-spring slide that is mounted for movement along the recoil-spring rod, and to the effect that a front contact surface of the contact element that is in contact with an internal surface of the breech device of the handgun provides design flexibility for the front region of the recoil-spring rod that abuts the front contact surface of the contact element and renders the same capable of being shaped such that it can be inserted, when provided with a simple geometric shape, into a recoil-spring eyelet that is likewise simple in design.

Typically, a front region of the recoil-spring rod is cylindrical in shape and is insertable into a cylindrical bore in the region of the front surface of the breech device.

According to a first preferred embodiment of the recoil-spring device of the invention, the contact element is provided in the form of a contact ring disposed between a spring-guiding member of the recoil-spring slide, said member being disposed near the recoil spring, and a component of the recoil-spring slide which is disposed on the breech side.

According to another preferred embodiment of the recoil-spring device of the invention, provision is made for the spring-guiding member of the recoil-spring slide to be insertable into a gap between the recoil-spring rod and the recoil spring.

Preferably, the component of the recoil-spring slide disposed on the breech side comprises a front end face that can be brought into contact with a rear locating surface of a front stop member on the recoil-spring rod.

According to an important preferred embodiment of the recoil-spring device of the invention, provision is made for the recoil-spring slide to comprise, in the region of its surface in contact with the recoil-spring rod, a plurality of guiding elements that engage with guideways in the region of the surface of the recoil-spring rod.

According to a further important preferred embodiment of the recoil-spring device of the invention, provision is made for the recoil-spring slide to comprise two subcomponents that can be assembled to form a functional unit on the recoil-spring rod.

Preferably, there are provided four guideways in the region of the surface of the recoil-spring rod, and each of the two subcomponents comprises two guiding elements, each of which is mounted in a guideway on the recoil-spring rod.

According to another important preferred embodiment of the recoil-spring device of the invention, provision is made for the component of the recoil-spring slide disposed on the breech side to protrude beyond the front stop member of the recoil-spring rod in order to form a protrusion to engage with a recess provided in the front surface of the breech device.

Preferably, the recoil spring mounted on the recoil-spring rod forms, in cooperation with the recoil-spring slide mounted for movement along the recoil-spring rod, a functional unit which can be inserted positively and effortlessly into a corresponding bearing of a handgun.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

The recoil-spring device of the invention is explained below with reference to a preferred embodiment illustrated in the figures of the drawing, in which.

Like reference numbers and designations in the various drawings indicate like elements.

DETAILED DESCRIPTION

Figure 1:
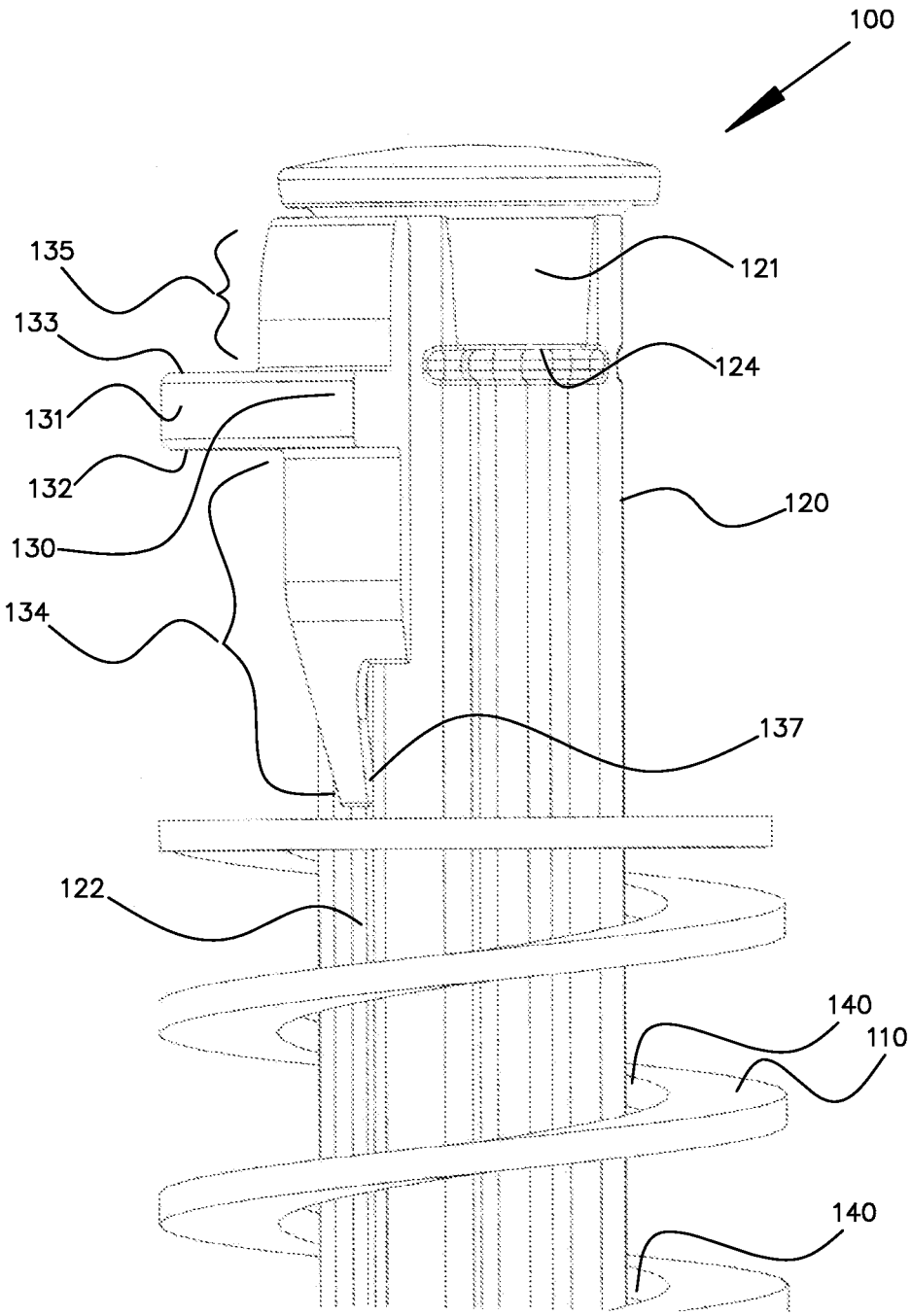
FIG. 1 is a side view of a preferred embodiment of the recoil-spring device of the invention.
Figure 2:
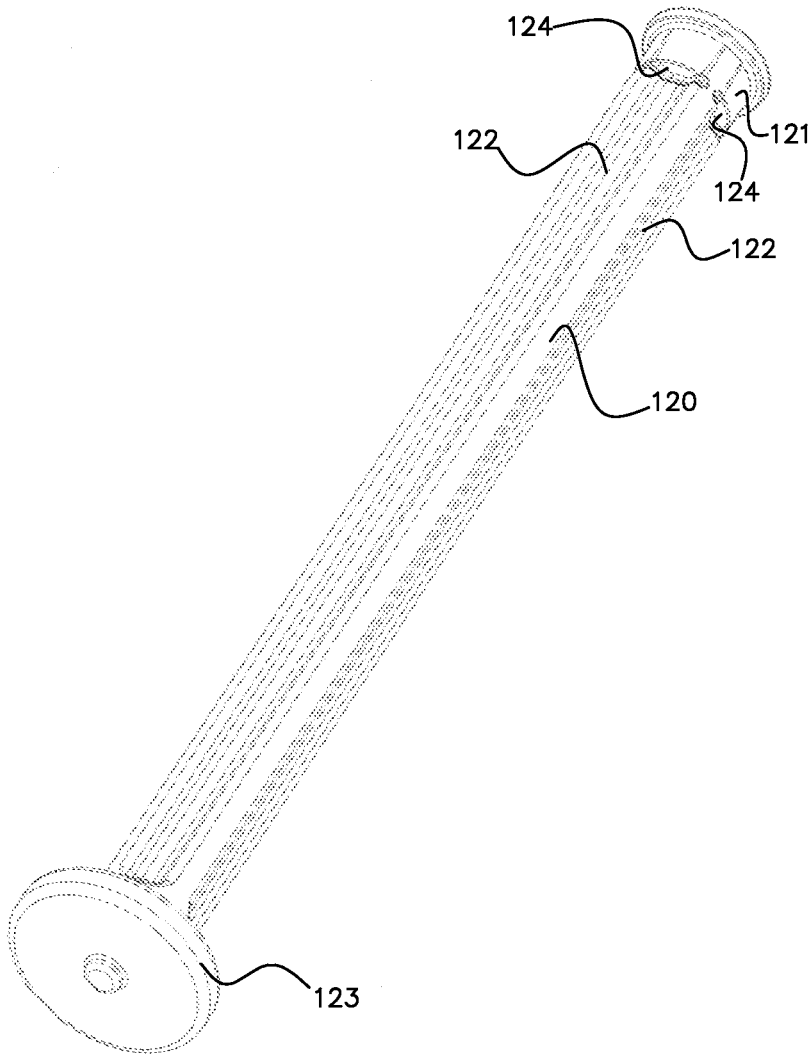
FIG. 2 is a view, taken obliquely from above, of the preferred embodiment of the recoil-spring device of the invention shown in FIG. 1, illustrating the recoil-spring rod.
Figure 3:
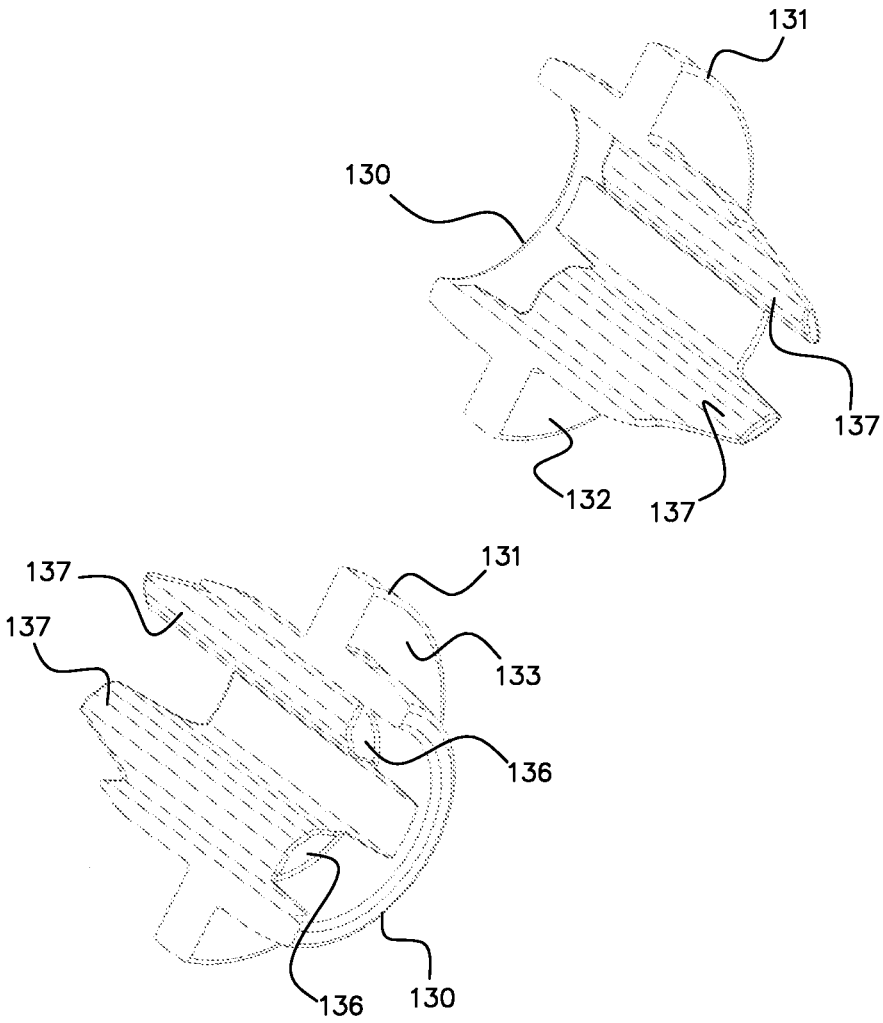
FIG. 3 is a view, taken obliquely from above, of the preferred embodiment of the recoil-spring device of the invention shown in FIG. 1, illustrating the recoil-spring slide.

The recoil-spring device 100 of the invention, which is intended for use in a handgun and is shown in FIGS. 1 and 3, comprises a recoil spring 110 which is in the form of a spiral spring and the rear end of which abuts a rear stop member 123 of a recoil-spring rod 120 and the front end of which is mounted for movement along the recoil-spring rod 120 with contraction of the recoil spring 110.

The front end of the recoil spring 110 abuts a rear contact surface 132 of a contact element 131 of a recoil-spring slide 130 that is mounted for movement along the recoil-spring rod 120, and a front contact surface 133 of the contact element 131 is in contact with an internal surface of the breech device of the handgun. The contact element 131 is in the form of a contact ring disposed between a spring-guiding member 134 of the recoil-spring slide 130, said member being disposed near the recoil spring (110), and a component 135 of the recoil-spring slide 130 which is disposed on the opposite front side.

The spring-guiding member 134 of the recoil-spring slide 130 is configured so as to be insertable into a gap 140 between the recoil-spring rod 120 and the recoil spring 110. FIG. 1 shows an outer surface of the spring-guiding member 134 tapering toward the rear stop member 123. The component 135 of the recoil-spring slide 130 disposed on the front side comprises a front end face 136 that can be brought into contact with a rear locating surface 124 of a front stop member 121 of the recoil-spring rod 120. FIG. 3 shows the front end face 136 recessed so as to allow the component 135 to receive the front stop member 121.

The recoil-spring slide 130 comprises, in the region of its surface in contact with the recoil-spring rod 120, a plurality of guide elements 137 that engage with matching guideways 122 disposed in the region of the surface of the recoil-spring rod 120. The recoil-spring slide 130 is composed of two subcomponents that form a functional unit on the recoil-spring rod 120. In the region of the surface of the recoil-spring rod 120 there are provided four guideways 122, and each of the two subcomponents comprises two guiding elements 137, each of which is mounted in a guideway 122 on the recoil-spring rod 120.

The component 135 of the recoil-spring slide 130 disposed on the breech side protrudes beyond the front stop member 121 of the recoil-spring rod 120 in order to form a protrusion to engage with a recess provided in the front surface of the breech device.

The recoil spring 110 mounted on the recoil-spring rod 120 forms a functional unit in cooperation with the recoil-spring slide 130 mounted for movement along the recoil-spring rod 120, which functional unit can be inserted positively and effortlessly into a corresponding bearing of a handgun.

The exemplary embodiment of the invention described above merely serves the purpose of providing better comprehension of the teaching of the invention defined in the claims, which teaching is not, as such, restricted to the exemplary embodiment.

What is claimed is:

1. A recoil-spring device (100) for a handgun comprising a breech device, the recoil-spring device comprising a recoil spring (110) which is in the form of a spiral spring and the rear end of which abuts a rear stop member (123) on a recoil-spring rod (120) and the front end of which is mounted for movement along said recoil-spring rod with contraction of the recoil spring (110), wherein:

the front end of said recoil spring (110) abuts a rear contact surface (132) of a contact element (131) of a recoil-spring slide (130) mounted for movement along said recoil-spring rod (120), while a front contact surface (133) of said contact element (131) is in contact with an internal surface of said breech device of the handgun;

said contact element (131) is in the form of a contact ring disposed between:

a spring-guiding member (134) on said recoil-spring slide (130) disposed near said recoil spring (110); and a component (135) of said recoil-spring slide (130) disposed on the front side; and said recoil-spring rod (120) has a front stop member (121) having a rear location surface (124) and said component (135) of said recoil-spring slide (130) disposed on the front side comprises a front end face (136) configured to be brought into contact with the rear locating surface (124) of the front stop member (121) of said recoil-spring rod (120).

2. The device as defined in claim 1, characterized in that said spring-guiding member (134) on said recoil-spring slide (130) is configured so as to be insertable into a gap (140) between said recoil-spring rod (120) and said recoil spring (110).

3. The device as defined in claim 1 characterized in that said recoil-spring slide (130) comprises, in the region of its surface in contact with said recoil-spring rod (120), a plurality of guide elements (137) that engage with matching guideways (122) disposed in the region of the surface of said recoil-spring rod (120).

4. The device as defined in claim 3 characterized in that said recoil-spring slide (130) is composed of two subcomponents that form a functional unit on said recoil-spring rod (120).

5. The device as defined in claim 4, characterized in that in the region of the surface of said recoil-spring rod (120) there are provided four guideways (122), and each of said two subcomponents comprises two guiding elements (137), each of which is mounted in a guideway (122) on the recoil-spring rod (120).

6. The device as defined in claim 5, characterized in that said component (135) of said recoil-spring slide (130) disposed on the front side protrudes beyond said front stop member (121) of said recoil-spring rod (120) in order to form a protrusion to engage with a recess provided in the region of a front surface of said breech device.

7. The device as defined in claim 1 characterized in that said recoil spring (110) mounted on said recoil-spring rod (120) forms a functional unit in cooperation with said recoil-spring slide (130) mounted for movement along said recoil-spring rod (120).

8. The device as defined in claim 1, characterized in that said component (135) of said recoil-spring slide (130) disposed on the front side protrudes beyond said front stop member (121) of said recoil-spring rod (120) in order to form a protrusion to engage with a recess provided in the region of a front surface of said breech device.

9. The device as defined in claim 8, characterized in that said recoil spring (110) mounted on said recoil-spring rod (120) forms a functional unit in cooperation with said recoil-spring slide (130) mounted for movement along said recoil-spring rod (120).

10. The device as defined in claim 8 characterized in that said recoil-spring slide (130) comprises, in the region of its surface in contact with said recoil-spring rod (120), a plurality of guide elements (137) that engage with matching guideways (122) disposed in the region of the surface of said recoil-spring rod (120).

11. The device as defined in claim 1, characterized in that said front stop member (121) having a rear location surface (124) and said component (135) of said recoil-spring slide (130) disposed on the front side comprises a front end face (136) configured to be brought into contact with a the rear locating surface (124) of a the front stop member (121) of said recoil-spring rod (120).

12. The device as defined in claim 11, characterized in that in the region of the surface of said recoil-spring rod (120) there are provided four guideways (122), and each of said two subcomponents comprises two guiding elements (137), each of which is mounted in a guideway (122) on the recoil-spring rod (120).

13. The device as defined in claim 1, characterized in that said recoil-spring slide (130) is composed of two subcomponents that form a functional unit on said recoil-spring rod (120).

14. The device as defined in claim 13, characterized in that said component (135) of said recoil-spring slide (130) disposed on the front side protrudes beyond said front stop member (121) of said recoil-spring rod (120) in order to form a protrusion to engage with a recess provided in the region of a front surface of said breech device.

15. The device as defined in claim 13, characterized in that said recoil spring (110) mounted on said recoil-spring rod (120) forms a functional unit in cooperation with said recoil-spring slide (130) mounted for movement along said recoil-spring rod (120).

16. A recoil-spring device (100) for a handgun comprising a breech device, the recoil-spring device comprising a recoil spring (110) which is in the form of a spiral spring and the rear end of which abuts a rear stop member (123) on a recoil-spring rod (120) and the front end of which is mounted for movement along said recoil-spring rod with contraction of the recoil spring (110), wherein:

the front end of said recoil spring (110) abuts a rear contact surface (132) of a contact element (131) of a recoil-spring slide (130) mounted for movement along said recoil-spring rod (120), while a front contact surface (133) of said contact element (131) is in contact with an internal surface of said breech device of the handgun;

said contact element (131) is in the form of a contact ring disposed between a spring-guiding member (134) on said recoil-spring slide (130) disposed near said recoil spring (110) and a component (135) of said recoil-spring slide (130) disposed on the front side; and the recoil-spring rod (120) has a front stop member (121) and said component (135) of said recoil-spring slide (130) disposed on the front side protrudes beyond said front stop member (121) of said recoil-spring rod (120) in order to form a protrusion to engage with a recess provided in the region of a front surface of said breech device.

17. The device as defined in claim 16, characterized in that said recoil spring (110) mounted on said recoil-spring rod (120) forms a functional unit in cooperation with said recoil-spring slide (130) mounted for movement along said recoil-spring rod (120).

18. A recoil-spring device (100) for a handgun comprising a breech device, the recoil-spring device comprising a recoil spring (110) which is in the form of a spiral spring and the rear end of which abuts a rear stop member (123) on a recoil-spring rod (120) and the front end of which is mounted for movement along said recoil-spring rod with contraction of the recoil spring (110), wherein:

the front end of said recoil spring (110) abuts a rear contact surface (132) of a contact element (131) of a recoil-spring slide (130) mounted for movement along said recoil-spring rod (120), while a front contact surface (133) of said contact element (131) is in contact with an internal surface of said breech device of the handgun;

said recoil-spring slide (130) comprises, in the region of its surface in contact with said recoil-spring rod (120), a plurality of guide elements (137) that engage with matching guideways (122) disposed in the region of the surface of said recoil-spring rod (120).

19. A recoil-spring device (100) for a handgun comprising a breech device, the recoil-spring device comprising a recoil spring (110) which is in the form of a spiral spring and the rear end of which abuts a rear stop member (123) on a recoil-spring rod (120) and the front end of which is mounted for movement along said recoil-spring rod with contraction of the recoil spring (110), wherein:

the front end of said recoil spring (110) abuts a rear contact surface (132) of a contact element (131) of a recoil-spring slide (130) mounted for movement along said recoil-spring rod (120), while a front contact surface (133) of said contact element (131) is in contact with an internal surface of said breech device of the handgun;

said recoil-spring rod (120) has a front first stop member (121) having a rear location surface (124) and said component (135) of said recoil-spring slide (130) disposed on the front side comprises a front end face (136) configured to be brought into contact with the rear locating surface (124) of the front stop member (121) of said recoil-spring rod (120)

in the region of the surface of said recoil-spring rod (120) there are provided four guideways (122), and each of said two subcomponents comprises two guiding elements (137), each of which is mounted in a guideway (122) on the recoil-spring rod (120).

20. A recoil-spring device (100) for a handgun comprising a breech device, the recoil-spring device comprising a recoil spring (110) which is in the form of a spiral spring and the rear end of which abuts a rear stop member (123) on a recoil-spring rod (120) and the front end of which is mounted for movement along said recoil-spring rod with contraction of the recoil spring (110), wherein:

the front end of said recoil spring (110) abuts a rear contact surface (132) of a contact element (131) of a recoil-spring slide (130) mounted for movement along said recoil-spring rod (120), while a front contact surface (133) of said contact element (131) is in contact with an internal surface of said breech device of the handgun;

said recoil-spring slide (130) is composed of two subcomponents that form a functional unit on said recoil-spring rod (120);

said recoil-spring rod (120) has a front stop member (121); and said component (135) of said recoil-spring slide (130) disposed on the front side protrudes beyond said front stop member (121) of said recoil-spring rod (120) in order to form a protrusion to engage with a recess provided in the region of a front surface of said breech device.

* * * * *